US011622657B2

(12) United States Patent
Crossing

(10) Patent No.: US 11,622,657 B2
(45) Date of Patent: Apr. 11, 2023

(54) BATHING CHAIR APPARATUS

(71) Applicant: Yvette Crossing, Marietta, GA (US)

(72) Inventor: Yvette Crossing, Marietta, GA (US)

( * ) Notice: Subject to any disclaimer, the term of this patent is extended or adjusted under 35 U.S.C. 154(b) by 138 days.

(21) Appl. No.: 17/340,560

(22) Filed: Jun. 7, 2021

(65) Prior Publication Data

US 2022/0386827 A1 Dec. 8, 2022

(51) Int. Cl.

| | |
|---|---|
| ***A61H 35/00*** | (2006.01) |
| ***A47K 7/04*** | (2006.01) |
| ***A61H 33/00*** | (2006.01) |
| ***A47K 7/08*** | (2006.01) |

(52) U.S. Cl.

CPC ..... *A47K 7/046* (2013.01); *A47K 7/08* (2013.01); *A61H 33/6021* (2013.01); *A61H 35/00* (2013.01); *A61H 2035/004* (2013.01); *A61H 2201/0149* (2013.01); *A61H 2201/1607* (2013.01); *A61H 2201/1623* (2013.01); *A61H 2201/1642* (2013.01)

(58) Field of Classification Search

CPC ..... A61H 33/6021; A61H 2035/004; A61H 2201/0149; A61H 2201/1607; A61H 2201/1623; A61H 2201/1642

USPC ..... 4/560.1

See application file for complete search history.

(56) References Cited

U.S. PATENT DOCUMENTS

| | | | | |
|---|---|---|---|---|
| 4,150,445 | A | 4/1979 | Bailey | |
| 4,160,292 | A * | 7/1979 | Kuether | A47K 3/022 4/615 |
| 4,521,926 | A * | 6/1985 | Kuether | A47K 3/022 4/579 |
| 5,459,887 | A | 10/1995 | Roman | |
| 6,842,919 | B2 * | 1/2005 | Wilson | A61G 7/1003 4/578.1 |
| 7,774,871 | B1 | 8/2010 | Arsenault | |
| 11,013,373 | B1 * | 5/2021 | Lumpkin | A61H 33/601 |
| 11,419,460 | B2 * | 8/2022 | Shyka | A61H 33/6021 |
| 2005/0039252 | A1 | 2/2005 | Fainberg | |
| 2019/0183293 | A1 * | 6/2019 | Day | A47K 3/122 |

FOREIGN PATENT DOCUMENTS

DE 102013005144 9/2013

* cited by examiner

*Primary Examiner* — Huyen D Le

(57) ABSTRACT

A bathing chair apparatus for safe and effective washing includes a base having a base platform and a plurality of base legs. A plurality of feet is coupled to the base. A lower body has a lower base portion coupled to the base platform and a leg portion extending from the lower base portion. The leg portion has a plurality of leg apertures. An upper body has an upper base portion pivotably coupled to the base platform and a back portion. The upper base portion and the back portion have a plurality of upper apertures. A plurality of nozzles is in fluid communication with the plurality of leg apertures and the plurality of upper apertures. A plurality of feeder tubes is coupled to the plurality of nozzles. A supply hose is in fluid communication with the plurality of feeder tubes and is engaged with a faucet.

12 Claims, 8 Drawing Sheets

BATHING CHAIR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bath chair devices and more particularly pertains to a new bath chair device for safe and effective washing. The present device includes a fixed lower leg portion and a swiveling upper chair portion. Both portions have integrated water jets.

(2) Description of Related Art Including Information Disclosed Under 37 CFR 1.97 and 1.98

The prior art relates to bath chair devices. Most known devices function as standard fixed shower chairs. Of those devices that swivel, they only include an upper chair portion and do not have integrated water jets. Known devices also lack a removable foot bath.

BRIEF SUMMARY OF THE INVENTION

An embodiment of the disclosure meets the needs presented above by generally comprising a base having a base platform and a plurality of base legs extending from the base platform. A plurality of feet is coupled to the base. The plurality of feet is coupled to a leg distal end of each of the base legs. A lower body is coupled to the base. The lower body has a lower base portion coupled to the base platform and a leg portion extending from the lower base portion. The leg portion has a plurality of leg apertures extending from a lower body outer side through a lower body inner side. The lower body is dimensioned to position the lower base portion at or above a rim of a bathtub. An upper body is coupled to the base. The upper body has an upper base portion pivotably coupled to the base platform and a back portion extending from the upper base portion. The upper base portion and the back portion have a plurality of upper apertures extending from an upper body outer side through an upper body inner side. A plurality of nozzles is coupled to the lower body and the upper body. The plurality of nozzles is in fluid communication with the plurality of leg apertures and the plurality of upper apertures. A plurality of feeder tubes is coupled to the plurality of nozzles. The plurality of feeder tubes is in fluid communication with the plurality of nozzles. A supply hose is coupled to the plurality of feeder tubes. The supply hose is in fluid communication with the plurality of feeder tubes and is configured to be engaged with a faucet of the bathtub.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
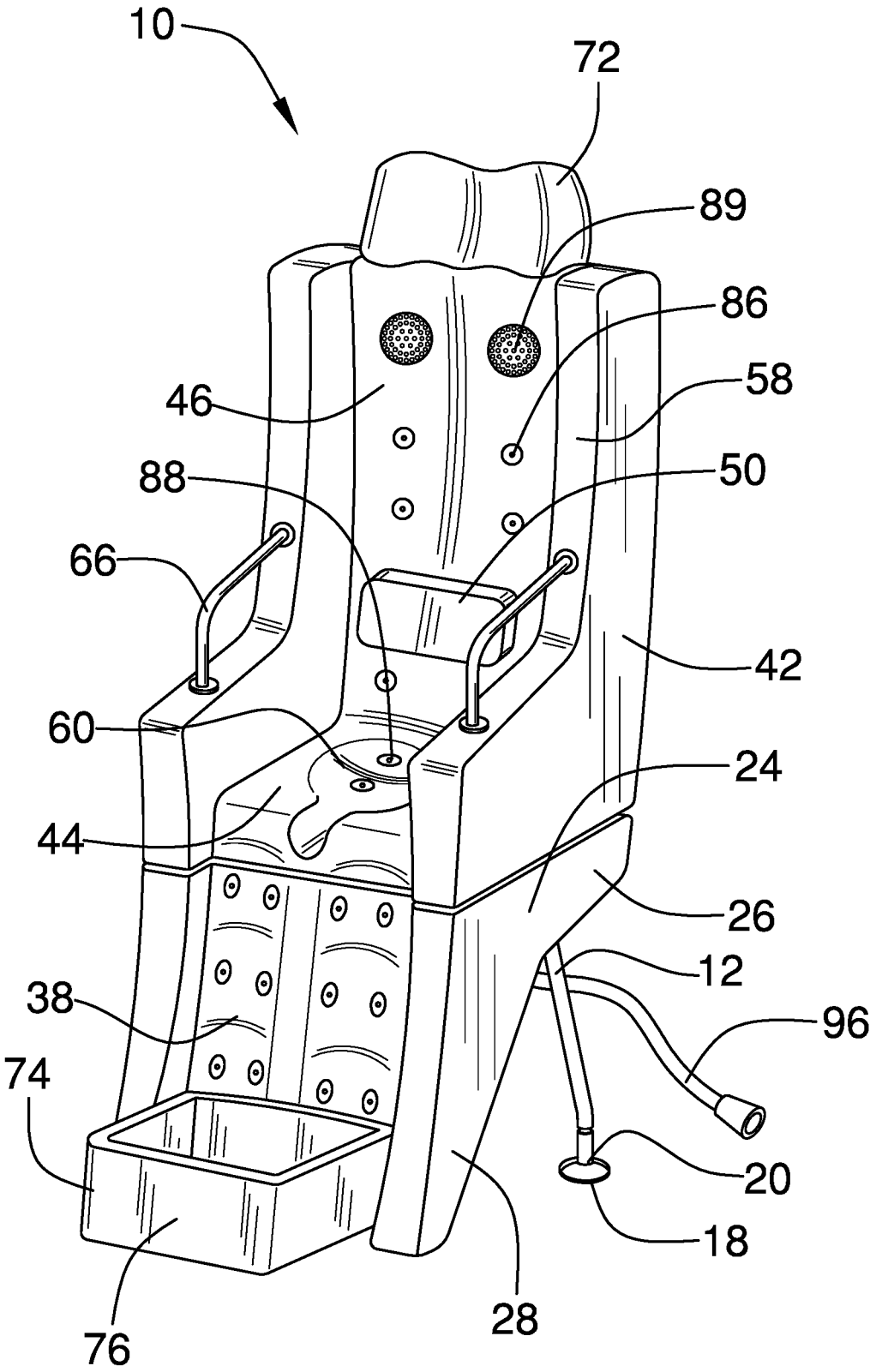
FIG. 1 is an isometric view of a bathing chair apparatus according to an embodiment of the disclosure.
Figure 2:
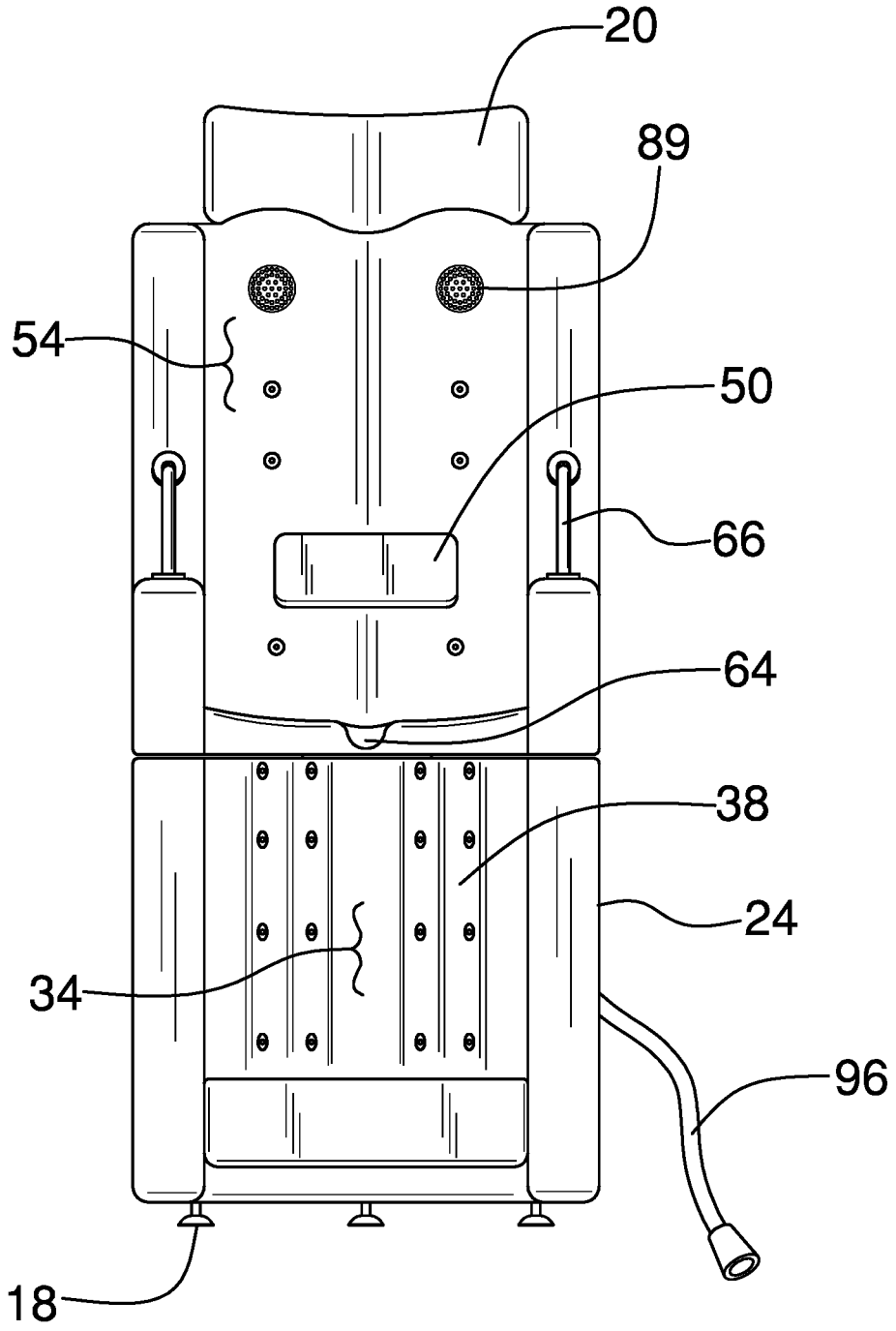
FIG. 2 is a front elevation view of an embodiment of the disclosure.
Figure 3:
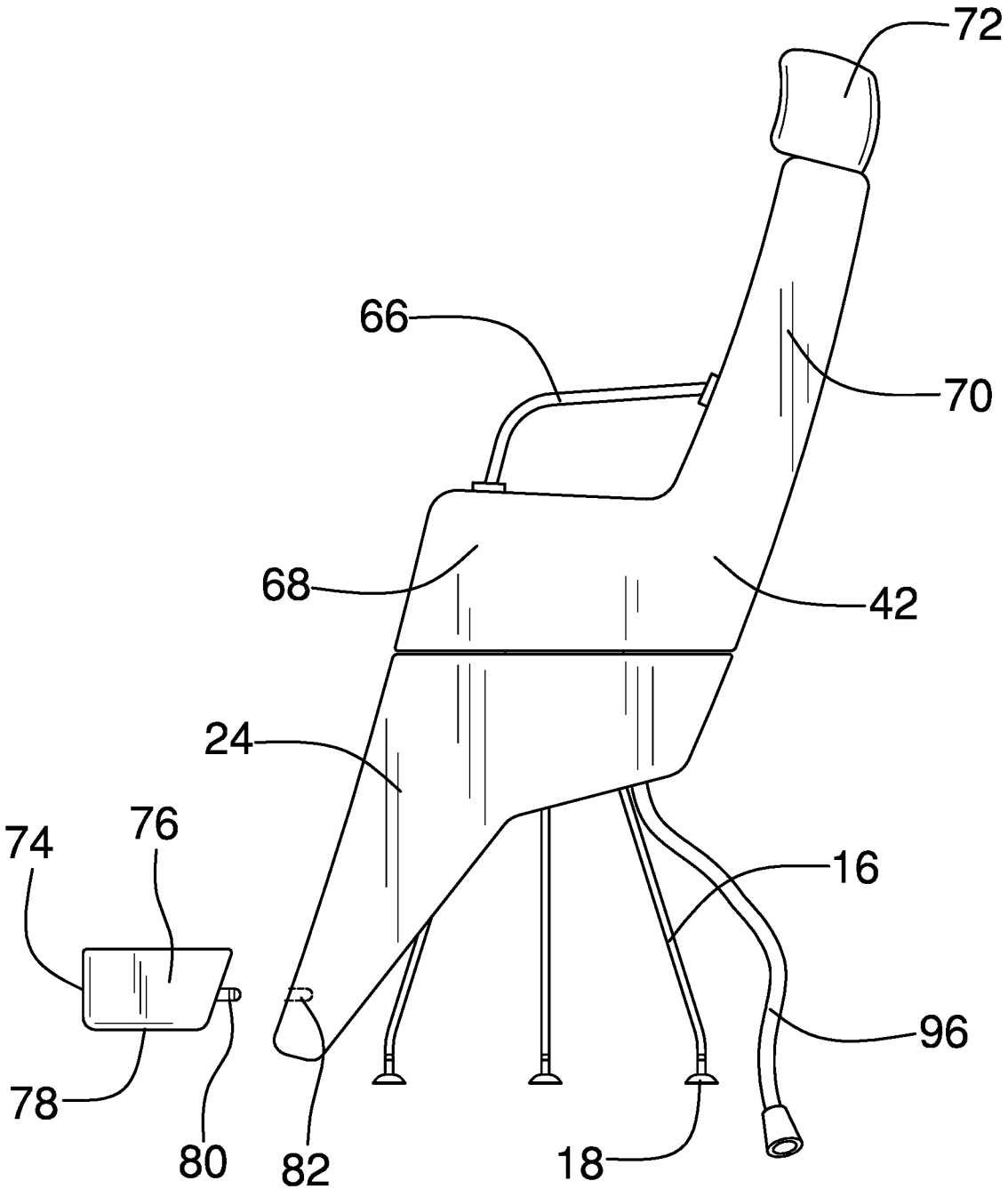
FIG. 3 is a side elevation view of an embodiment of the disclosure.
Figure 4:
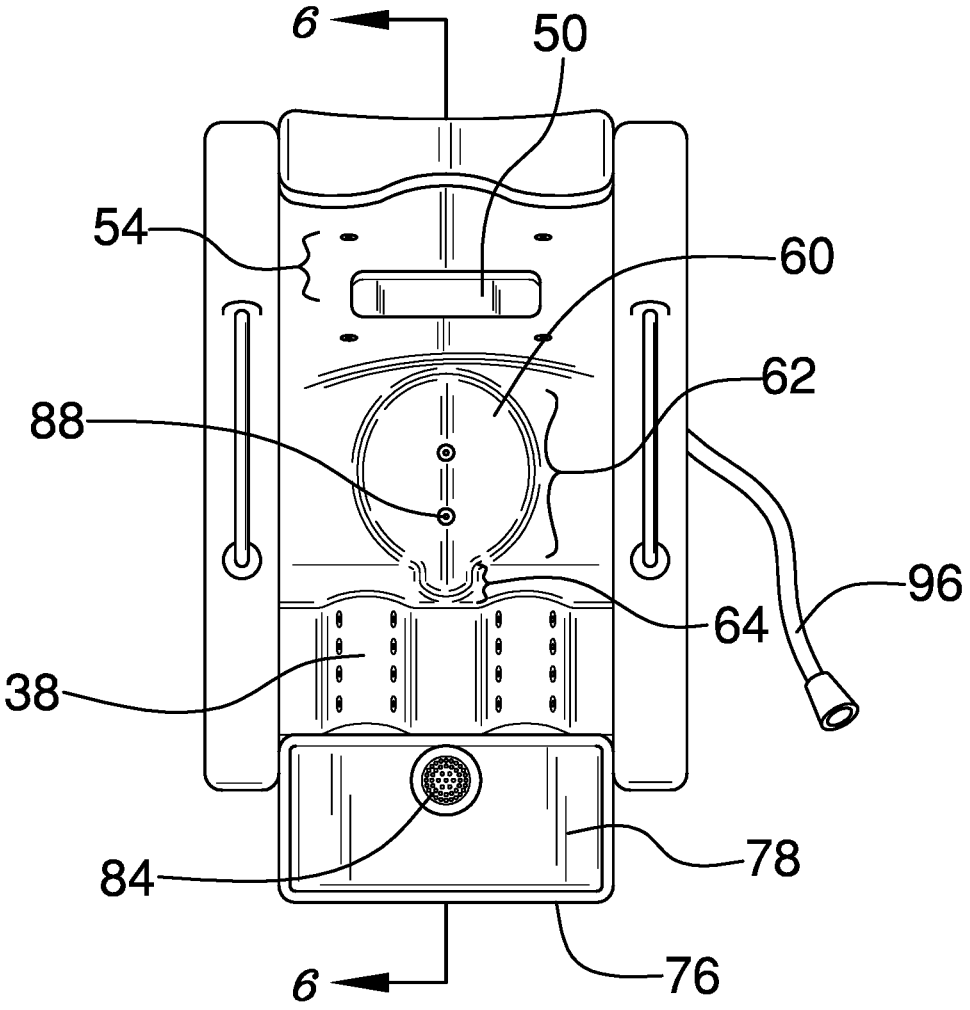
FIG. 4 is a top plan view of an embodiment of the disclosure.
Figure 5:
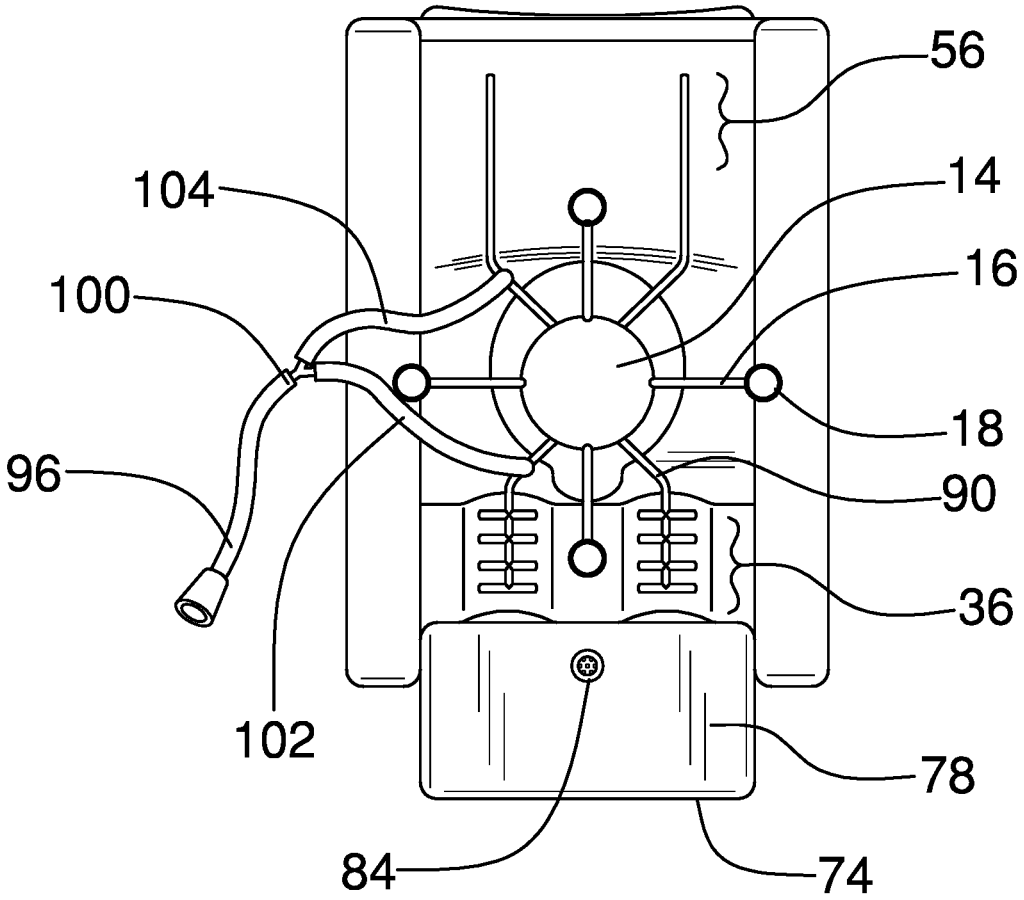
FIG. 5 is a bottom plan view of an embodiment of the disclosure.
Figure 6:
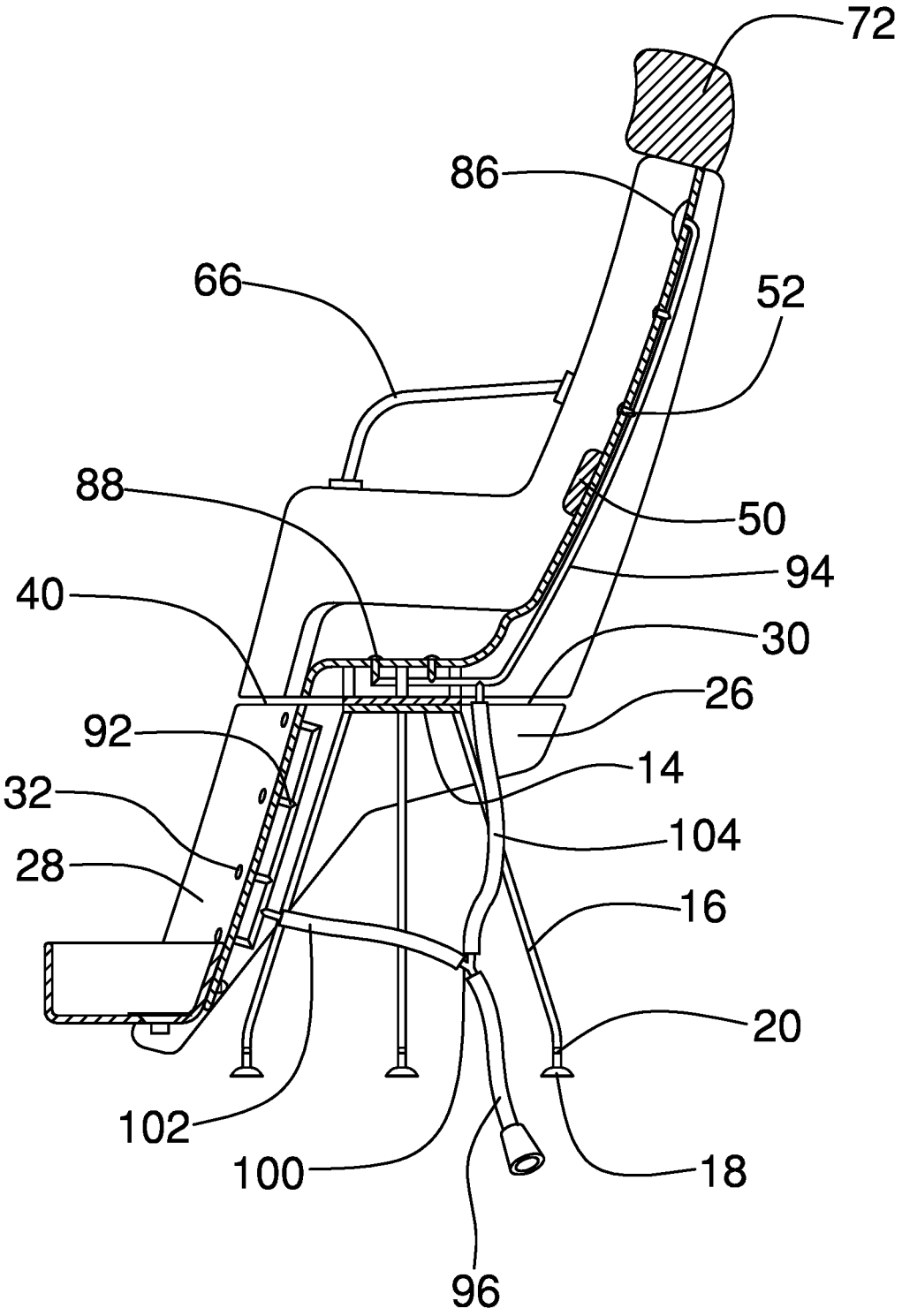
FIG. 6 is a cross-sectional view of an embodiment of the disclosure.
Figure 7:
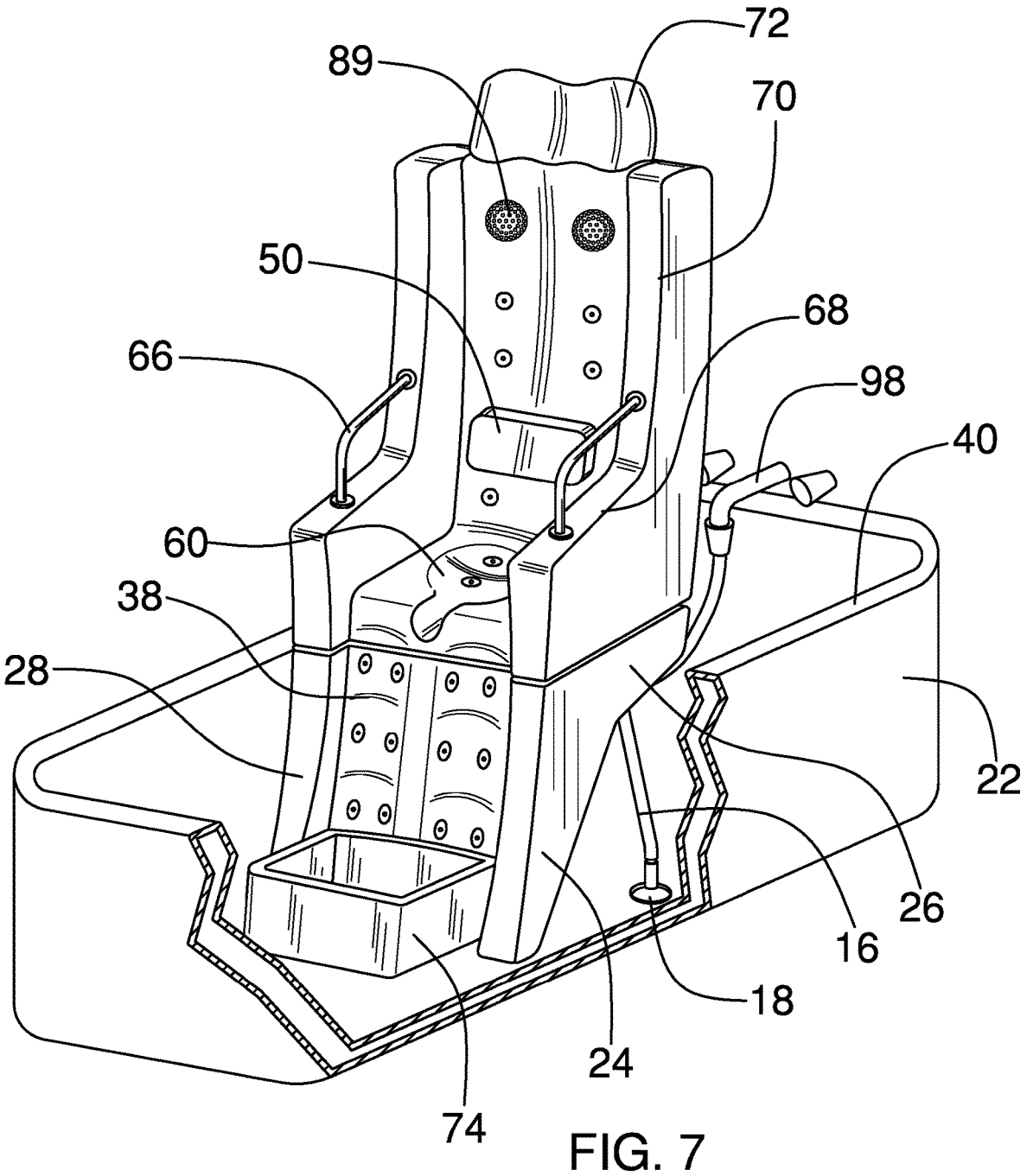
FIG. 7 is an in-use view of an embodiment of the disclosure.
Figure 8:
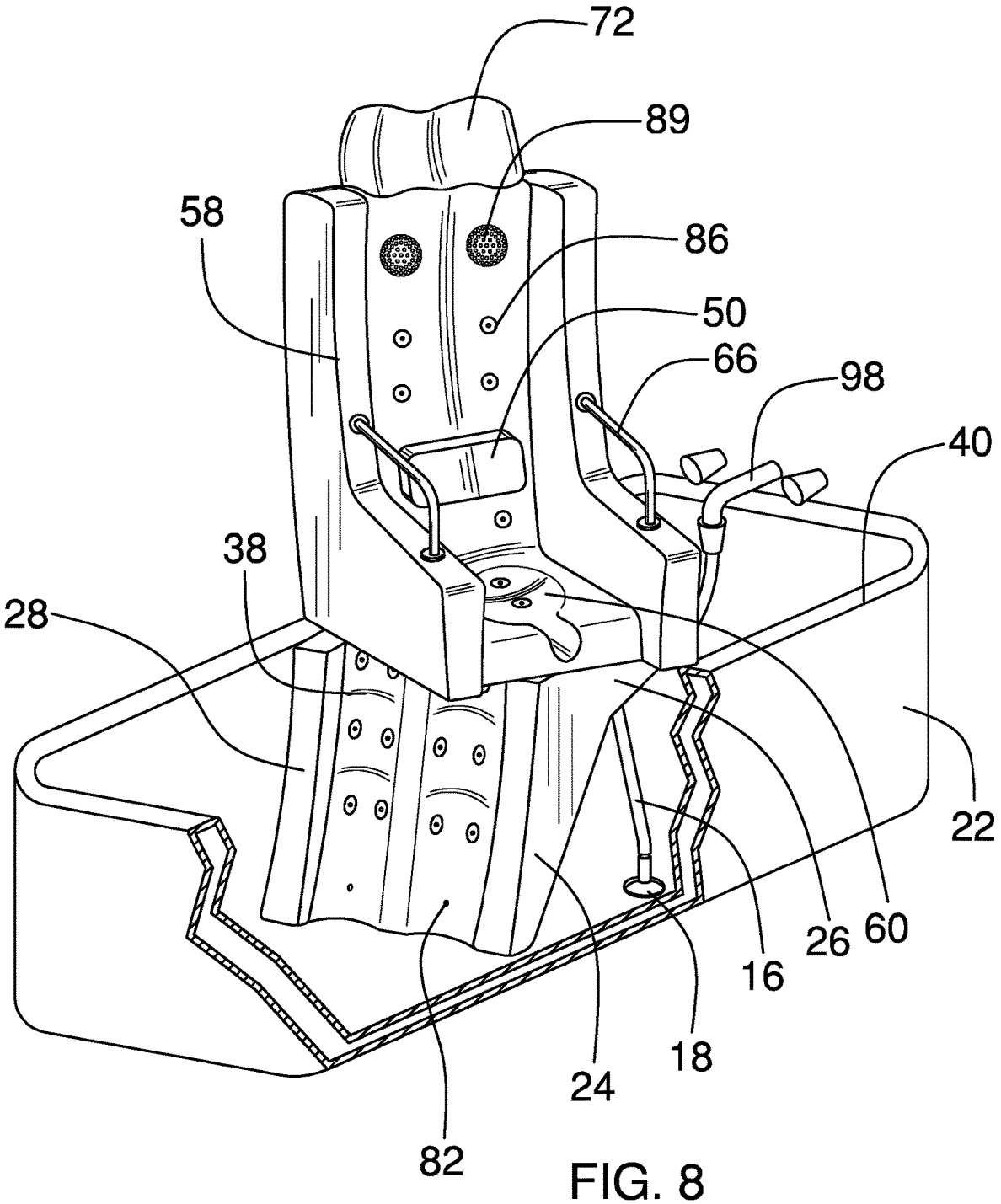
FIG. 8 is an in-use view of an embodiment of the disclosure.

With reference now to the drawings, and in particular to FIGS. 1 through 8 thereof, a new bath chair device embodying the principles and concepts of an embodiment of the disclosure and generally designated by the reference numeral 10 will be described.

As best illustrated in FIGS. 1 through 8, the bathing chair apparatus 10 generally comprises a base 12 having a base platform 14 and a plurality of base legs 16 extending from the base platform 14. The plurality of base legs 16 may be four base legs 16. A plurality of feet 18 is coupled to the base 12. The plurality of feet 18 is coupled to a leg distal end 20 of each of the base legs. The plurality of feet 18 may be swivelable suction cups in order to prevent slippage in a bathtub 22.

A lower body 24 is coupled to the base 12. The lower body 24 has a lower base portion 26 coupled to the base platform 14 and a leg portion 28 extending from the lower base portion 26. A base top face 30 of the lower base portion lies horizontally. The leg portion 28 has a plurality of leg apertures 32 extending from a lower body outer side 34 through a lower body inner side 36. The leg portion 28 may have a pair of recessed leg channels 38 to ergonomically accommodate the user's legs. The plurality of leg apertures 32 extends through the pair of recessed leg channels 38. The lower body 24 is dimensioned to position the lower base portion 26 at or above a rim 40 of the bathtub.

An upper body 42 is coupled to the base 12. The upper body 42 has an upper base portion 44 pivotably coupled to the base platform 14 and a back portion 46 extending from the upper base portion 44. A base bottom face 48 of the upper base portion 44 lies horizontally in parallel opposition to the base top face 30 of the lower base portion. The upper body 42 may thus rotate above the rim 40 of the bathtub to allow the user to sit into the apparatus 10 without stepping into the bathtub 22.

The back portion 44 may have a lumbar protrusion 50. The lumbar protrusion 50 may be rectangular and cushioned. The upper base portion 44 and the back portion 46 have a plurality of upper apertures 52 extending from an upper body outer side 54 through an upper body inner side 56. The upper body 42 may have a pair of lateral side portions 58 extending along the upper base portion 44 and the back portion 46. The upper body outer side 54 of the upper base portion may have a bidet depression 60. The bidet depression 60 has a round portion 62 and a drainage portion 64.

A pair of handles 66 may be coupled to the upper body 42. The pair of handles 66 extends between a lower lateral portion 68 and a back lateral portion 70 of each of the lateral side portions. A headrest 72 may be coupled to the upper body 42. The headrest 72 is coupled to the back portion 46 and may be cushioned. A foot bath 74 may be coupled to the lower body 24. The foot bath 74 has a foot sidewall 76 selectively engageable with the leg portion 28 and a foot bottom 78. The foot sidewall 76 may have a pair of engagement pins 80 to selectively engage a pair of receiving cavities 82 within the leg portion. The foot bottom 78 has a drainage aperture 84 extending therethrough.

A plurality of nozzles 86 is coupled to the lower body 24 and the upper body 42. The plurality of nozzles 86 is in fluid communication with the plurality of leg apertures 32 and the plurality of upper apertures 52. A pair of bidet nozzles 88 of the plurality of nozzles is positioned within the bidet depression 60. A pair of shower head nozzles 90 may be positioned proximal the headrest 72.

A plurality of feeder tubes 90 is coupled to the plurality of nozzles 86. The plurality of feeder tubes 90 is in fluid communication with the plurality of nozzles 86. The plurality of feeder tubes 90 may include a network of lower feeder tubes 92 coupled to the leg portion 28 of the lower body and a network of upper feeder tubes 94 coupled to the upper body 42. A supply hose 96 is coupled to the plurality of feeder tubes 90. The supply hose is in fluid communication with the plurality of feeder tubes 90 and is configured to be engaged with a faucet 98 of the bathtub. The supply hose 96 may have a splitter 100 and a lower hose 102 coupled to the network of lower feeder tubes 92 and an upper hose 104 coupled to the network of upper feeder tubes 94.

In use, the supply hose 96 is engaged with the faucet 98 and the plurality of feet 18 are engaged with the bathtub 22. The user sits in the upper body 42 and then rotates the upper body 42 to align with the lower body 24 within the bathtub 22. The user then may bathe with the water coming through the plurality of nozzles 86 while remaining seated in the apparatus.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing chair apparatus comprising:

a base having a base platform and a plurality of base legs extending from the base platform;

a plurality of feet coupled to the base, the plurality of feet being coupled to a leg distal end of each of the base legs;

a lower body coupled to the base, the lower body having a lower base portion coupled to the base platform and a leg portion extending from the lower base portion, the leg portion having a plurality of leg apertures extending from a lower body outer side through a lower body inner side, the lower body being dimensioned to position the lower base portion at or above a rim of a bathtub;

an upper body coupled to the base, the upper body having an upper base portion pivotably coupled to the base platform and a back portion extending from the upper base portion, the upper base portion and the back portion having a plurality of upper apertures extending from an upper body outer side through an upper body inner side;

a plurality of nozzles coupled to the lower body and the upper body, the plurality of nozzles being in fluid communication with the plurality of leg apertures and the plurality of upper apertures a plurality of feeder tubes coupled to the plurality of nozzles, the plurality of feeder tubes being in fluid communication with the plurality of nozzles; and a supply hose coupled to the plurality of feeder tubes, the supply hose being in fluid communication with the plurality of feeder tubes and being configured to be engaged with a faucet of the bathtub.

2. The bathing chair apparatus of claim 1 further comprising a foot bath coupled to the lower body, the foot bath having a foot sidewall selectively engageable with the leg portion and a foot bottom, the foot bottom having a drainage aperture extending therethrough.

3. The bathing chair apparatus of claim 1 further comprising the leg portion of the lower body having a pair of recessed leg channels, the plurality of leg apertures extending through the pair of recessed leg channels.

4. The bathing chair apparatus of claim 1 further comprising a headrest coupled to the upper body, the headrest being coupled to the back portion.

5. The bathing chair apparatus of claim 1 further comprising the upper body having a pair of lateral side portions extending along the upper base portion and the back portion.

6. The bathing chair apparatus of claim 5 further comprising a pair of handles coupled to the upper body, the pair of handles extending between a lower lateral portion and a back lateral portion of each of the lateral side portions.

7. The bathing chair apparatus of claim 1 further comprising the back portion having a lumbar protrusion.

8. The bathing chair apparatus of claim 1 further comprising the plurality of feeder tubes including a network of lower feeder tubes coupled to the leg portion of the lower body and a network of upper feeder tubes coupled to the upper body; the supply hose having a splitter and a lower hose coupled to the network of lower feeder tubes and an upper hose coupled to the network of upper feeder tubes.

9. The bathing chair apparatus of claim 1 further comprising the plurality of feet being swivelable suction cups.

10. The bathing chair apparatus of claim 1 further comprising the upper body outer side of the upper base portion having a bidet depression; a pair of bidet nozzles of the plurality of nozzles being positioned within the bidet depression.

11. The bathing chair apparatus of claim 10 further comprising the bidet depression having a round portion and a drainage portion.

12. A bathing chair apparatus comprising:

a base having a base platform and a plurality of base legs extending from the base platform;

a plurality of feet coupled to the base, the plurality of feet being coupled to a leg distal end of each of the base legs, the plurality of feet being swivelable suction cups;

a lower body coupled to the base, the lower body having a lower base portion coupled to the base platform and a leg portion extending from the lower base portion, the leg portion having a plurality of leg apertures extending from a lower body outer side through a lower body inner side, the leg portion of the lower body having a pair of recessed leg channels, the plurality of leg apertures extending through the pair of recessed leg channels, the lower body being dimensioned to position the lower base portion at or above a rim of a bathtub;

an upper body coupled to the base, the upper body having an upper base portion pivotably coupled to the base platform and a back portion extending from the upper base portion, the back portion having a lumbar protrusion, the upper base portion and the back portion having a plurality of upper apertures extending from an upper body outer side through an upper body inner side, the upper body having a pair of lateral side portions extending along the upper base portion and the back portion, the upper body outer side of the upper base portion having a bidet depression, the bidet depression having a round portion and a drainage portion;

a pair of handles coupled to the upper body, the pair of handles extending between a lower lateral portion and a back lateral portion of each of the lateral side portions;

a headrest coupled to the upper body, the headrest being coupled to the back portion;

a foot bath coupled to the lower body, the foot bath having a foot sidewall selectively engageable with the leg portion and a foot bottom, the foot bottom having a drainage aperture extending therethrough;

a plurality of nozzles coupled to the lower body and the upper body, the plurality of nozzles being in fluid communication with the plurality of leg apertures and the plurality of upper apertures, a pair of bidet nozzles of the plurality of nozzles being positioned within the bidet depression;

a plurality of feeder tubes coupled to the plurality of nozzles, the plurality of feeder tubes being in fluid communication with the plurality of nozzles, the plurality of feeder tubes including a network of lower feeder tubes coupled to the leg portion of the lower body and a network of upper feeder tubes coupled to the upper body; and a supply hose coupled to the plurality of feeder tubes, the supply hose being in fluid communication with the plurality of feeder tubes and being configured to be engaged with a faucet of the bathtub, the supply hose having a splitter and a lower hose coupled to the network of lower feeder tubes and an upper hose coupled to the network of upper feeder tubes.

* * * * *